US007850475B1

(12) United States Patent
Feldman et al.

(10) Patent No.: US 7,850,475 B1
(45) Date of Patent: Dec. 14, 2010

(54) APPARATUS FOR PCI EXPRESS ADD-IN CARD RETENTION

(76) Inventors: Michael Feldman, 148 Carl Tennen St., Thornhill, Ont (CA) L4J 7B1; Alexander Feldman, 35 Fifefield Dr., Maple, Ont (CA) L6A 1J2; Boris Feldman, 148 Carl Tennen St., Thornhill, Ont (CA) L4J 7B1

( * ) Notice: Subject to any disclaimer, the term of this patent is extended or adjusted under 35 U.S.C. 154(b) by 0 days.

(21) Appl. No.: 12/456,426

(22) Filed: Jun. 17, 2009

(51) Int. Cl.
*H01R 13/62* (2006.01)

(52) U.S. Cl. ..... 439/328

(58) Field of Classification Search ..... 439/62, 439/325–328
See application file for complete search history.

(56) References Cited

U.S. PATENT DOCUMENTS 5,454,726 A * 10/1995 Lee et al. ..... 439/65
5,949,657 A * 9/1999 Karabatsos ..... 361/803
6,183,284 B1 * 2/2001 Gill et al. ..... 439/327
6,319,037 B1 * 11/2001 Lai ..... 439/327
6,358,079 B1 * 3/2002 Noble ..... 439/328
6,655,976 B1 * 12/2003 Shipe et al. ..... 439/328
6,769,927 B2 * 8/2004 Brewer ..... 439/328
6,971,900 B2 * 12/2005 Liebenow ..... 439/327
7,077,679 B1 * 7/2006 Szuba et al. ..... 439/327
7,239,529 B1 * 7/2007 Chang ..... 361/809
2004/0121644 A1 * 6/2004 Ling et al. ..... 439/353
2006/0242345 A1 * 10/2006 Berl ..... 710/301

* cited by examiner

*Primary Examiner*—Briggitte R Hammond

(57) ABSTRACT

Apparatus for PCI express add-in card retention into PCI express female connector. Said apparatus prevents wiggling of PCI express add-in cards in case the PCI express connector has retention ridge or not.

7 Claims, 6 Drawing Sheets

APPARATUS FOR PCI EXPRESS ADD-IN CARD RETENTION

CROSS-REFERENCE TO RELATED APPLICATION

This is the first application filed for the present invention.

TECHNICAL FIELD

The present invention relates to retention means for PCI express add-in cards.

BACKGROUND

Today the majority of the electronic systems are built using different module combinations. The example of such system is the Personal Computer (PC). Its main processor block and main memory are placed on the motherboard, and the additional functional devices (interfaces) are placed on the add-in cards that can be plugged into the female connectors on this motherboard. Such architecture type is very flexible, and systems based on this architecture can be easily customized to fit almost any application.

The modern electronic systems are designed for handling the high speed data traffic between external peripheral devices and main processor. The peripheral devices like HDTV displays, Gigabit Ethernet, Fiber-optic telecommunication require a high bandwidth interface for interconnection between said motherboard (main processor and main memory) and plug-in peripheral interface cards. The PCI express standard defines the new high speed serial interface for device interconnection. To-day the speed of this interface is equal to 2.5 Gbit/sec or 5 Gbit/sec and in the latest revision can go up-to 8 Gbit/sec (for comparison: the original PCI interface uses 33/66 MHz speed).

The PCI express interface includes PCI express Link of dual unidirectional differential Links, implemented as a Transmit pair and a Receive pair. The PCI express Link has to have at least one Lane that represents a set of differential signal pairs (one pair for transmission, one pair for reception). For scale bandwidth of the PCI express interface, a Link may aggregate multiple Lanes denoted by xN where N may be any of supported Link widths. The PCI express specification defines operation for x1, x2, x8, x12, x16 and x32 Lane widths.

For support of this high speed interface the PCI express specification defines the special connectors for the PCI express add-in card and for motherboard. These connectors have different lengths that depend on quantities of said Lanes aggregated in this PCI express Link. At the same time PCI express connector has special means (retention means) for retaining said PCI express add-in card (stabilization) when it is plugged into the PCI express female motherboard connector. These means include Retention Ridge on the connector and "hockey stick" on the PCI express x16 add-in cards.

The PCI express interface is the high speed interface, and the qualitative connection between PCI express add-in card and the motherboard is one of the important parameters that define reliability of computer operation. The mechanical connection is one of the problematic places. The stability of connection resistance and capacitance depend on the immobility of the PCI express add-in card, which is inserted into the motherboard connector, during the operation. Impacts and vibration have an affect on this.

PCI express add-in cards can have the holes (defined by specification) for installing add-in card retainer (bracket) and for fixing PCI express card inside the computer chassis. In addition to the bracket the x16 PCI express add-in cards (with long x16 link connector) have the "hockey stick" that can be held by special retention means placed on the motherboard.

All these standard means that define by PCI express specification can not completely solve the problem of stabilization of said add-in card during operation. The "hockey stick" can be implemented only on x16 PCI express add-in cards. The bracket for holding PCI-express add-in card can not be used in some chassis (for example, a custom made embedded chassis).

There are many different ways how to improve add-in card stabilization inside the motherboard connector.

Many patents denoted to the problem of said add-in card fastening in the connector. It is possible to allocate some groups, using:

1) various types of brackets (U.S. Pat. No. 6,331,940, Wan-Cheng L.) TW248707, U.S. Pat. No. 6,361,343 (Daskalakis G., et al.), 2) "hockey stick" (U.S. Pat. No. 6,672,888, Yueh-Chu K.) or additional tabs on the add-in card (Pat. Appl. US 20040121644, Ling Yun, et al.), U.S. Pat. No. 6,824,413 (Fhipe J., et al.), 3) an additional supporting tab (U.S. Pat. No. 7,255,570, Feldman M., et al), 4) special cartridges surrounding the cards and fastening to main board (Pat. Appl. US 20020109975, Boe G.), 5) special cartridges surrounding the connector (U.S. Pat. No. 6,358,079, N. Scott), and 6) card retainer that presses said card to corresponding connector (U.S. Pat. No. 6,183,284, Gill S., et al), etc.

The devices concerning first three types have similar problems. The devices using cartridges are bulky. The patents: U.S. Pat. No. 6,358,079 (N. Scott), U.S. Pat. No. 6,655,976 (Shipe J. E., et al.), U.S. Pat. No. 6,769,927 (Brewer J.) and U.S. Pat. No. 6,183,284 (Gill S., et al) are most interesting and close to the present invention.

U.S. Pat. No. 6,358,079 (N. Scott) the retention mechanism surrounds the connector located on the base board. It comprises fingers that are located from two sides. These fingers are intended for latching into the notches formed in the add-in card. The offered retention mechanisms of both embodiments are compound and are used together with bracket, and don't exclude possible backlash between surfaces of said fingers and interiors of said notches. The fastening having a similar backlash cannot prevent completely small displacement (wiggling) of the add-in card that in the given patent is took up by a special bracket.

U.S. Pat. No. 6,655,976 (Shipe J. E., et al.) shows a retention clip having a holding post, and its post inserted into and through a hole that is formed on the add-in card. The retention mechanism includes the hook having a downward tapered surface and that is fixed to upright standing body. For its engagement it is necessary that said hook is fallen little bit lower than retention ridge and not press add-in card to female connector. This solution prevents only unplug the add-in card but doesn't prevent wiggling the add-in card inside PCI express female connector during operation.

U.S. Pat. No. 6,769,927 (Brewer J.) represents a variant of a card retention member close to previous patent. A hook placed on the end of said card retention member is movably mounted on the card and must be engaged to the surface of a catch. For this purpose the hook must fall lower than retention ridge and not press add-in card to female connector.

Both of those patents (U.S. Pat. No. 6,655,976 and U.S. Pat. No. 6,183,284) are useless in case if the PCI express female connector has no retention ridge (retention ridge is the optional based on PCI express specification).

U.S. Pat. No. 6,183,284 (Gill S., et al) represents a variant of a card retainer. This solution has very narrow implementation. The space between PCI express female connector and motherboard based on PCI express specification is maximum 1 mm. This makes almost impossible to use this retainer on general motherboard because this space usually blocked by surface mount components (ceramic capacitors, resistors etc.) around the PCI express female connector. At the same time practically it is not possible to make this type of clip because it has to be not conductive and fit under the PCI express female connector (the maximum dimension can be 1 mm by 0.5 mm).

Thus said retention means do not provide simple qualitative connection of high-frequency devices in actual practice conditions.

SUMMARY

The first aspect of present invention consists in that a support bar is rigidly fastened to the surface of the PCI express add-in card so that, when said add-in card is inserted into a PCI express female connector, one surface (first) of said support bar is in parallel to the top surface of the PCI express female connector and touches (presses against) the top surface of the PCI express female connector. It prevents the possibility of wiggling the PCI express add-in card.

The second aspect of present invention consists in that a strip is fastened to the surface of said PCI express card. This strip is rigidly fastened to said surface by its ended part, and this strip comprises a hook located on opposite side of it. It could be engaged with a retention ridge of said PCI express female connector in case that it exists.

The third aspect of present invention consists in that said hook that is fastened to the second edge of said strip. The geometry, sizes and elasticity of said strip and hook are chosen such that said hook can be inserted under said retention ridge and pressed said support bar against top surface of said PCI express female connector when said add-in PCI express card is completely inserted into said PCI express female connector.

The fourth aspect of present invention consists in that said hook presses said add-in PCI express card to the PCI express female connector. It excludes a possibility of any wiggling.

The fifth aspect of present invention consists in that because the stabilization of said PCI express add-in card is done by support bar the width of said hook can be narrow.

The sixth aspect of present invention consists in that through hole for fastening said support bar and/or said strip is located on the line approximately belonging to the center line of the mechanical key cut-out on a PCI express add-in card male connector. This is the free space of PCI express high-speed signal routing on said add-in card.

The present invention works on any size of PCI express add-in card.

The present invention is the simple and cost effective solution and provides reliable stabilization of the add-in card into the PCI express female connector.

DETAILED DESCRIPTION OF INVENTION

Figure 1:
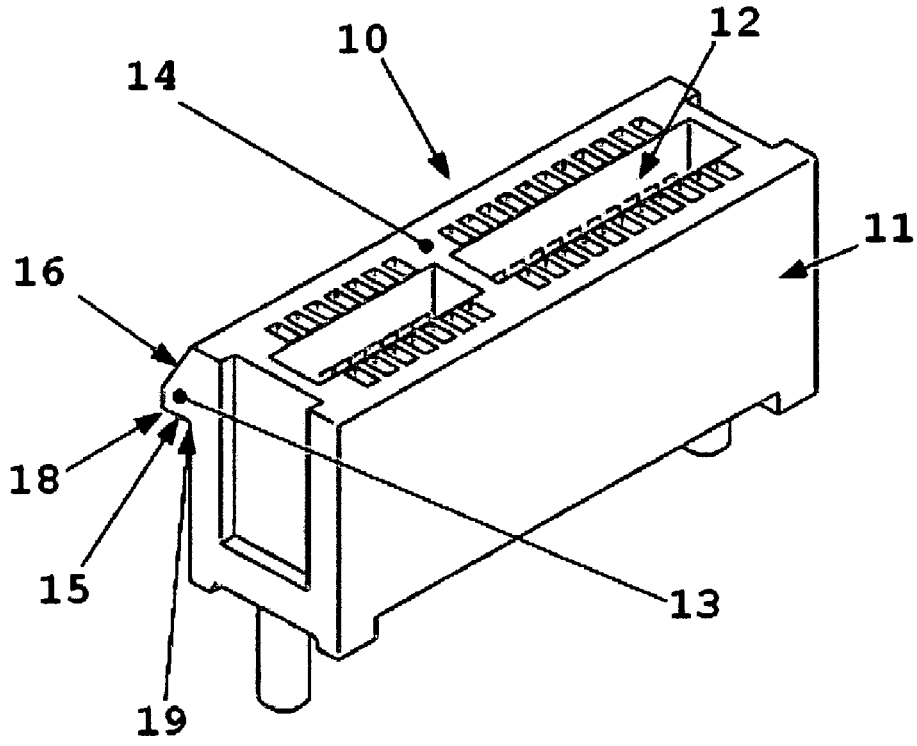
FIG. 1 represents the PCI express connector.

FIG. 1 illustrates the PCI express female connector 10 according to the PCI express Card Electromechanical Specification. It comprises a housing 11, a top surface 14, a slot 12 for inserting the PCI express add-in card, and a retention ridge 13. The retention ridge 13 comprises a bottom surface 15 and lateral inclined surface 16. FIG. 1 shows two points 18 and 19. The point 18 corresponds to transition from "insertion mode" to a "hooking mode", and the interval between said points 18 and 19 corresponds to a "hooking" condition.

Figure 2:
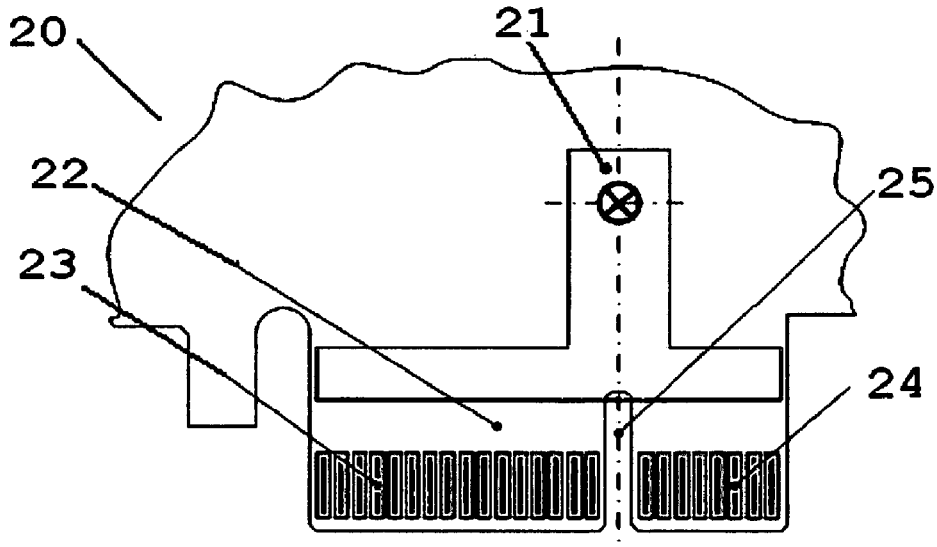
FIG. 2 represents a fragment of the PCI express add-in card.

FIG. 2 illustrates a fragment of the PCI express add-in card 20. Said PCI express add-in card 20 comprising a PCI express connector 22 (plug) and support tab 21 that is mechanically fixed on the top surface of the PCI express add-in card 20. The PCI express add-in card plug connector 22 comprising contact lamellas 23-24. Said PCI express connector 22 is divided into two parts of said lamellas 23 and 24. The gap 25 (a mechanical key) is located between said parts 23 and 24.

Figure 3:
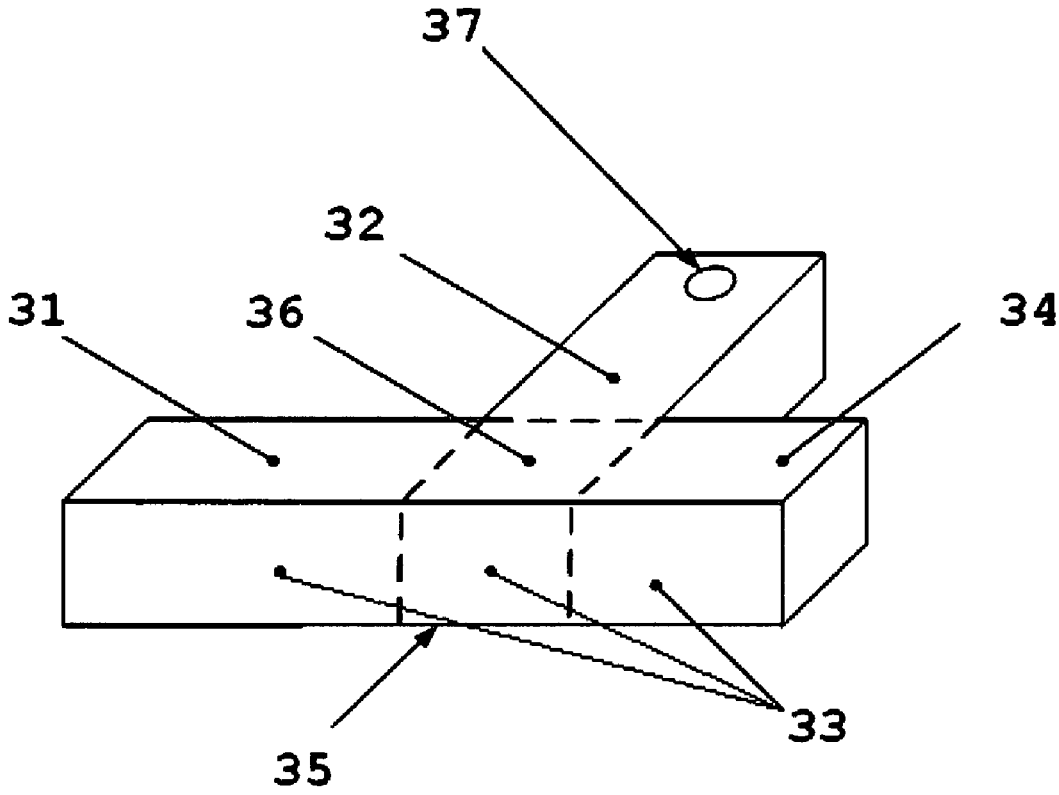
FIG. 3 shows an example of said support bar.

FIG. 3 shows a example of one embodiment of said support bar 21 made in the view of T-like form (this form is one of the possible forms of implementation). The bar 21 consists of two parts: a longitudinal part 32 and a transversal part 31-34 (FIG. 2). The surface 33 is the first support surface that touches to the top flat surface 14 of the PCI express female connector, at least, in two points. The second surface 35 (bottom, placed from below) of said bar 21 is intended for fastening to the PCI express add-in card top surface, for example, with the help of a screw via through hole 37 or a glue (not shown). The third surface consists of the following parts 31, 36, 34 and 32. The longitudinal part 32-36 is intended for placing said strip 41.

The longitudinal part 32-36 of said bar is located so that its central line is coincided approximately to the central line of the mechanical key 25 of PCI express plug connector 22 (see FIG. 2). This location is usually free from components and high speed traces in the PCI express add-in card. The through hole 37 is intended for fastening said bar to said add-in card. Said retention means can be included also the second support bar that is fastened from the bottom side of this PCI express add-in card 20 by similar manner (it is not shown).

When the PCI express add-in card 20 is inserted into PCI express female connector 10 then said surface 33 of said support bar 21 touches the top surface 14 of the PCI express female connector 10. In this case support tab 21 is laying on the surface 14 of the PCI express female connector 10 and preventing wiggling of the add-in card.

Figure 4:
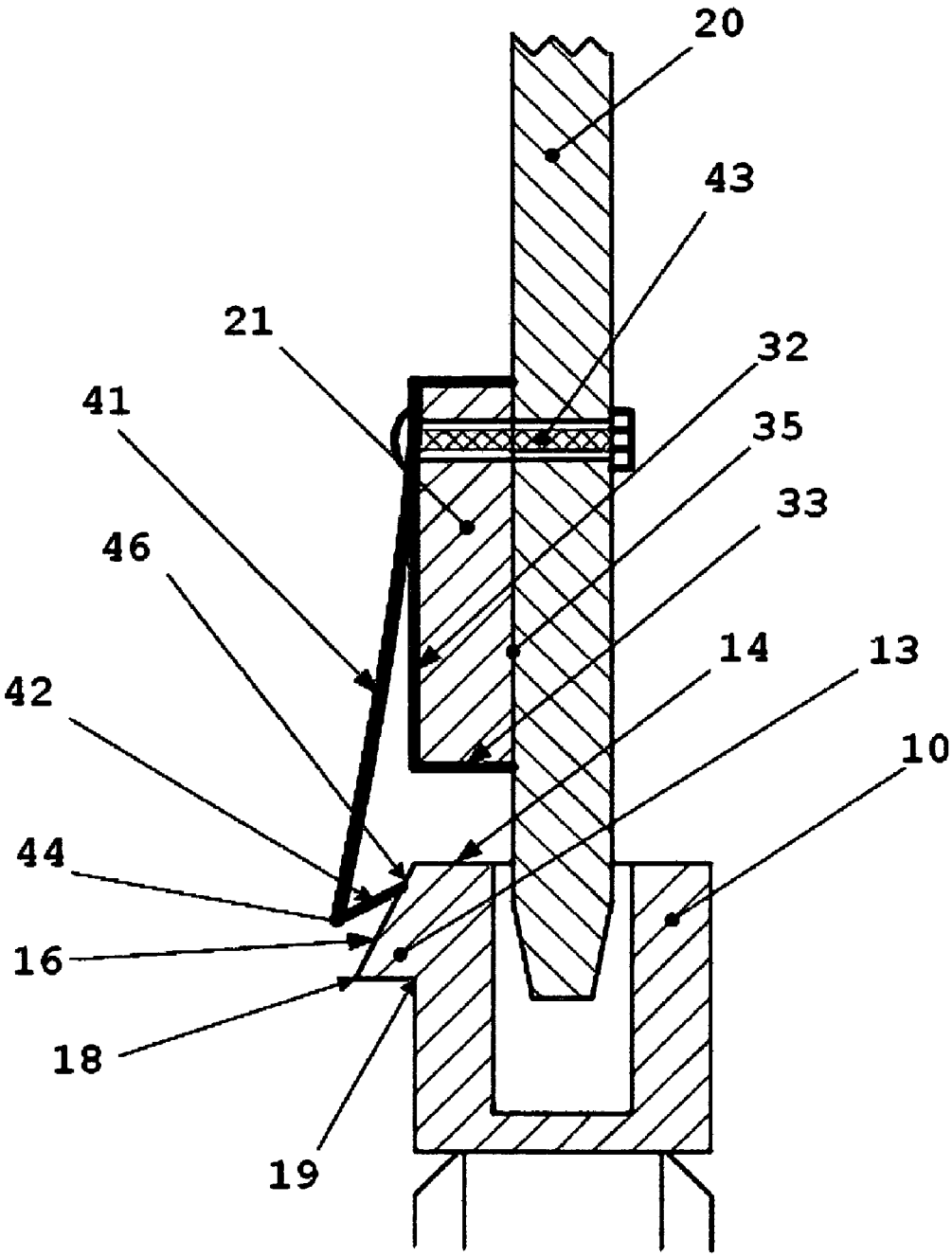
FIG. 4 shows a view of said strip, hook, support bar, PCI express female connector and the PCI express add-in card during insertion into PCI express female connector.

FIG. 4 shows a cross-section of one intermediate position when said PCI express add-in card 20 together with said bar 21 and a resilient strip 41 are inserting into said PCI express female connector 10. It is shown the lateral surface 16 of the retention ridge 13. It is shown also that a looking hook 42 is placed on the second end of said strip 41.

The purpose of the strip 41 is to press said surface 33 to said surface 14. This is why the width of said strip 41 can be very small (approximately to 4 mm). This is the very important because sometimes the components on the motherboard are placed close to PCI express female connector and it can make not possible to lock said hook 42 under the retention ridge 13.

The strip 41 may be fastened to said support bar or to said PCI express add-in card 20. The first end of said strip 41 is fastened on the PCI express add-in card 20 or on the said support tab 21 or can be the part of support tab 21. Said looking hook 42 can be made (as a bended hook) from the said strip. The bar can be clued to said add-in card and be fixed by one or two grown washers. Said strip can be fastened also regardless of said bar mounted on the add-in card if said longitudinal part is absent. The only requirement, it is necessary to ensure rigid fastening of said bar on the add-in card so that in the case when said add-in card is fully inserted into said connector the first support surface 33 of said bar 21 would be in parallel with the top surface 14 of the PCI express female connector 10 and would touch to (lay on) said surface 14.

FIG. 4 and FIG. 5 illustrate also an operation process how said retention means are used. During the process of inserting said PCI express add-in card 20 into the connector 10 the end point 46 of the looking hook 42 moving along surface 16 of the retention ridge 13. When the PCI express add-in card 20 full inserted into PCI express female connector 10 the support tub 21 is laying on the top surface 14 of the PCI express female connector 10 and the end point 46 of the looking hook 42 move to position between points 18 and 19. In this condition the looking hook 42 continuously presses support tab 21 to PCI express female connector 10.

Figure 5A:
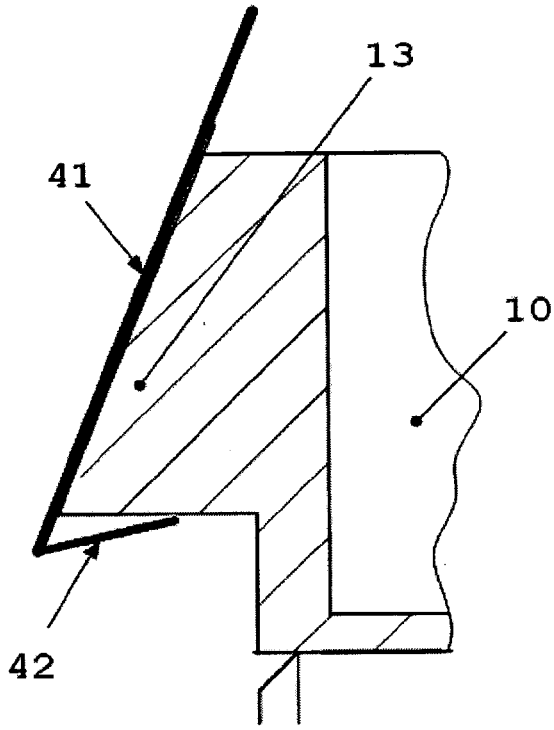
FIG. 5 represents various positions and types of the retention means.
Figure 5B:
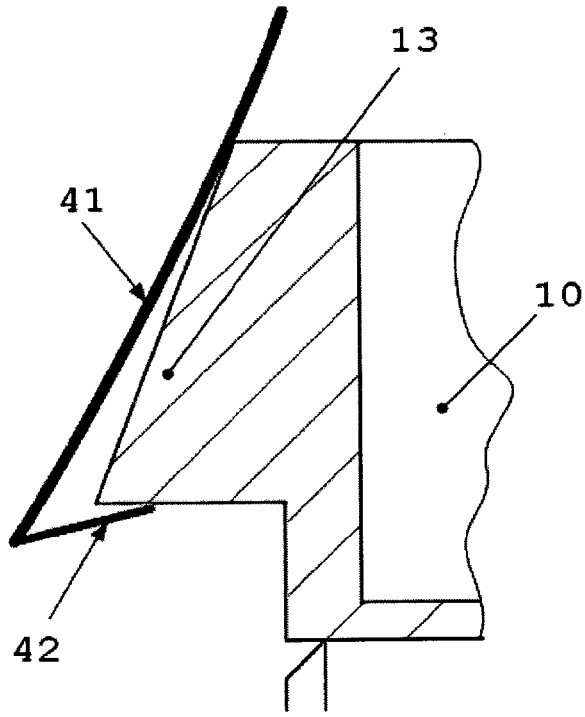

Depending on the sizes and the parameters of the retention means there are two possible cases: 1) the strip 41 is straightened completely after the PCI express add-in card was inserted; 2) the strip 41 remains bent. FIG. 5A and FIG. 5B illustrate these cases.

Figure 5C:
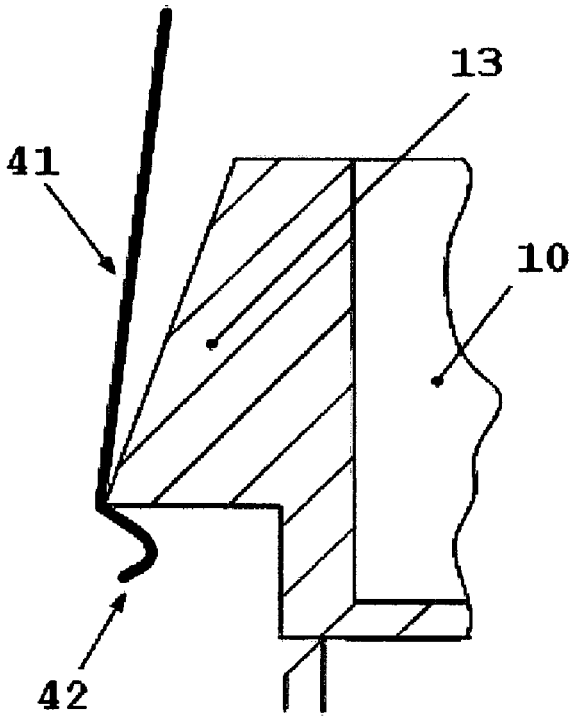
Figure 5D:
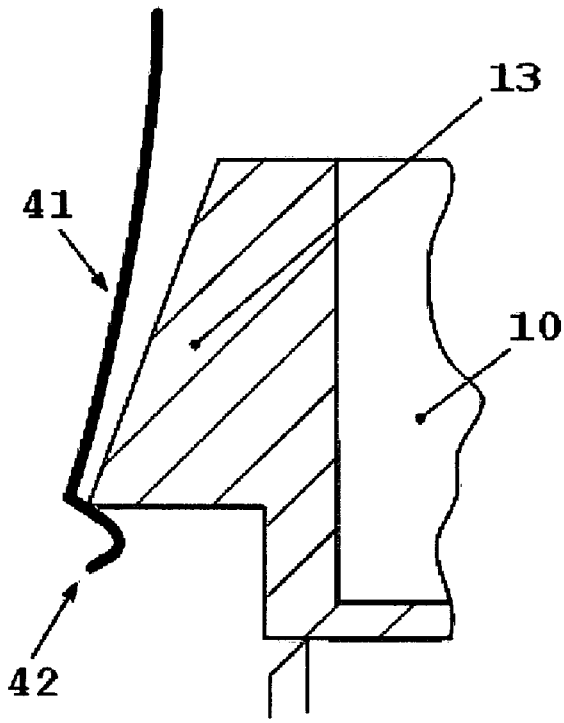

FIG. 5C and FIG. 5D show two additional embodiments by using the highly curved hook. The strip 41 is pressed to the retention ridge 16 that prevents its displacement.

Figure 6A:
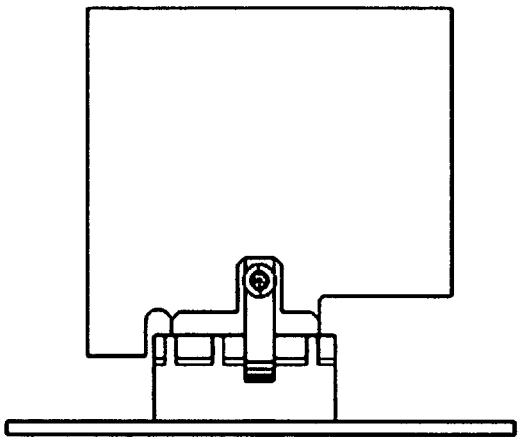
FIG. 6A, FIG. 6B and FIG. 6C illustrate three space views of said PCI add-in card inserted into the PCI express female socket.
Figure 6B:
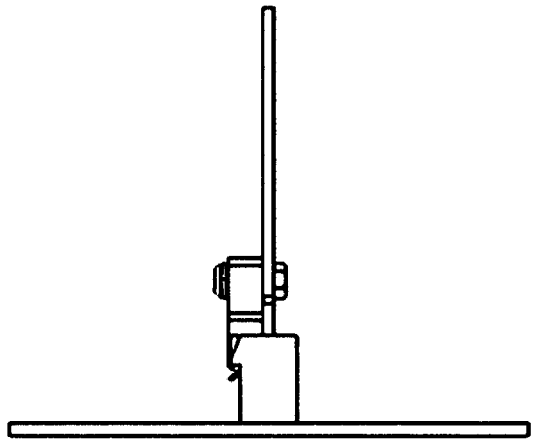
Figure 6C:
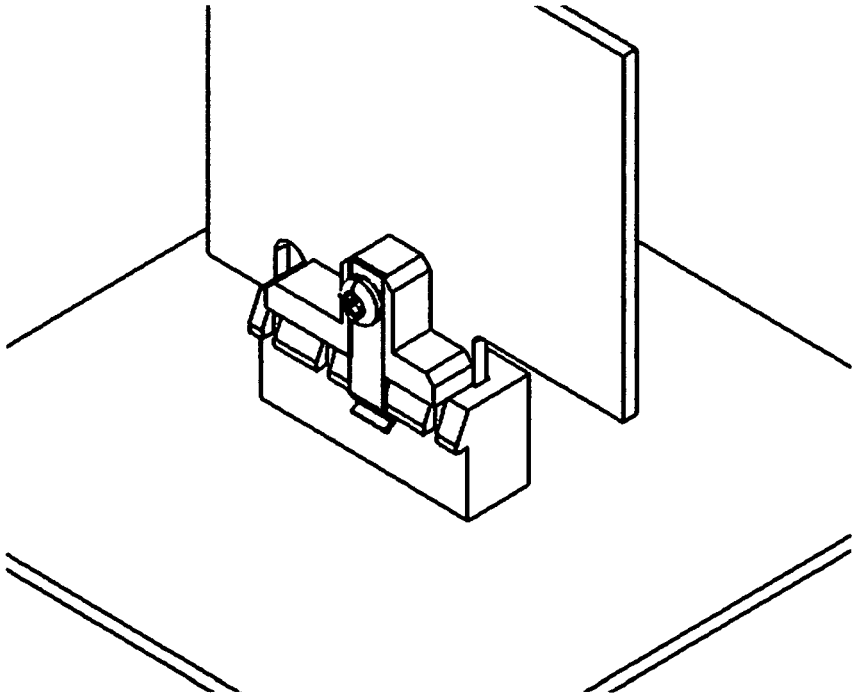

FIG. 6A, FIG. 6B and FIG. 6C illustrate three space views of said PCI add-in card inserted into PCI express female socket, using the offered retention means.

We claim:

1. An apparatus for PCI express add-in card retention, comprising:

a PCI express add-in card with a PCI express edge male connector, a PCI express female connector, comprising a slot on its top surface for inserting/removing said PCI express add-in card, retention means for securing said PCI express add-in card into said PCI express female connector;

wherein said retention means comprise:

a support bar having at least three surfaces, said surfaces are characterized in that the first and the second surfaces are flat (planes) and they are perpendicular to each other, said support bar is fastened to said add-in PCI express card in one or more points so that said second surface of said support bar lays on the PCI express add-in card surface, and the first surface of said support bar touches the PCI express female connector's top surface when said PCI express add-in card is inserted into said slot.

2. The apparatus according to claim 1, wherein in the case when said PCI express female connector comprises a retention ridge said retention means comprise additionally:

a flat strip, one (first) of its ends is fastened to said PCI express add-in card by the way chosen from following:

a) directly to top surface of the said PCI express add-in card, b) said strip is fastened to said third surface of said support bar and said support bar is placed on the top surface of the PCI express add-in card, c) said strip is a part of said support bar and said support bar is placed on the top surface of the PCI express add-in card;

a locking hook is intended to engage to the retention ridge of said PCI express female connector and placed on the second end of said strip;

said apparatus that is characterized in that:

the assembly, consisting of said strip and said hook, are capable to press said support bar against said top surface of the PCI express female connector when said PCI express add-in card is inserted into said slot.

3. The apparatus according to claim 2, wherein:

the geometry, the sizes and elasticity of said assembly are chosen so that:

during insertion of PCI express add-in card into PCI express female connector said locking hook placed on the second end of said strip and can engage with said retention ridge, in the case when said PCI express add-in card has been inserted into said PCI express female connector said locking hook is continuously presses said support bar against said PCI express female connector top surface.

4. The apparatus according to claim 3, wherein:

at least a part of an assembly comprising said strip and locking hook is resilient.

5. The apparatus according to claim 2, wherein:

said retention means are located approximately in line with the mechanical key cut-out on said PCI express add-in card male connector.

6. The apparatus according to claim 2, wherein:

said add-in PCI express card comprises a through hole that is located on the line approximately belonging to the center line of the mechanical key cut-out on said PCI express add-in card male connector allowing fastening said support bar and/or said strip.

7. The apparatus according to claim 1, wherein:

said retention means include an additional support bar, that is fastened to said PCI express add-in card on another opposite surface of said PCI express add-in card.

* * * * *